US006122775A

United States Patent [19]

Jacuzzi et al.

[11] Patent Number: 6,122,775

[45] Date of Patent: Sep. 26, 2000

[54] DRAIN VALVE ASSEMBLY AND METHOD OF CLEANSING

[75] Inventors: Remo C. Jacuzzi; Jeffrey L. Cunningham, both of Little Rock, Ark.

[73] Assignee: Jason International, Inc., North Little Rock, Ark.

[21] Appl. No.: 09/373,997

[22] Filed: Aug. 16, 1999

Related U.S. Application Data

[60] Provisional application No. 60/129,628, Apr. 16, 1999.

[51] Int. Cl.[7] ..... A61H 33/06

[52] U.S. Cl. ..... 4/541.5; 4/541.4

[58] Field of Search ..... 4/541.5, 541.4, 4/541.3, 541.2, 541.1, 541.6, 682, 688; 137/605, 602

[56] References Cited

U.S. PATENT DOCUMENTS

| | | | |
|---|---|---|---|
| 3,345,982 | 10/1967 | Guiler | 601/157 |
| 3,452,370 | 7/1969 | Jacuzzi | 4/541.3 |
| 4,857,112 | 8/1989 | Franninge | 4/541.1 |
| 5,381,831 | 1/1995 | Verland | 137/868 |
| 5,383,239 | 1/1995 | Mathis et al. | 4/541.1 |

*Primary Examiner*—Steven O. Douglas
*Assistant Examiner*—Huyen Le
*Attorney, Agent, or Firm*—Banner & Witcoff, Ltd.

[57] ABSTRACT

A drain valve assembly for use with an air bath including an air distribution system and a method of cleansing channels of an air distribution system for a bath vessel. The drain valve assembly is located within an opening in the bath vessel to control the flow of water from the bath vessel to an effluent drain, to control the flow of air and water from the air distribution system to an effluent drain and to maintain a fluid pressure within the air distribution system. The drain valve assembly includes a valve housing for extending between the bath vessel and a fluid waste pipe connected to the effluent drain. The valve housing has an upper opening for positioning proximate the bath vessel and a lower opening for receiving fluid from the air bath distribution system. The drain valve assembly also includes a stopper having first and second vertically aligned plungers. The stopper is secured within the valve housing and is capable of moving relative thereto. When the stopper is in a closed position and the second plunger is positioned below a lower surface of the lower opening, fluid from the air distribution system is sealed within the valve housing and fluid within the bath vessel is prevented from entering the valve housing. Conversely, fluid from the bath vessel and the air distribution system flows through the valve housing and into the fluid waste pipe when the stopper is in an open position and the second plunger is above a lower surface of the lower opening.

35 Claims, 10 Drawing Sheets

DRAIN VALVE ASSEMBLY AND METHOD OF CLEANSING

Benefit of the Apr. 16, 1999 filing date of the provisional application Ser. No. 60/129,628 by the same inventors and entiled "Drain Valve Assembly" is hereby claimed.

The present invention relates to a drain valve assembly for use with a bath vessel, more particularly, the invention relates to a drain valve for use with a therapeutic air bath to maintain fluid in the bath vessel and fluid pressure within an air distribution system when in a closed position, and to allow drainage of the fluid from both the bath vessel and the air distribution system when in an open position. The present invention also relates to a method of cleansing the air distribution system.

BACKGROUND OF THE INVENTION

For many years, baths have been used as effective therapeutic tools for relieving aliments and increasing blood flow. One known type of bath is commonly referred to as an "air bath" and includes a plurality of air jets for agitating the water contained in a bath vessel. Air baths rely on the forced air and agitated water for providing the therapeutic benefit to the user. Air baths typically include a vessel for receiving a user and the water, a plurality of air channels fit to the outside and undersurface of the vessel and a source of pressurized air, such as an air blower, connected to the channels. The channels include a plurality of openings aligned with openings in the lower floor and/or sidewall of the vessel. The blower forces air into the channels and through the openings resulting in aeration and percolation of the water. A well known type of this bath is disclosed in U.S. Pat. No. 4,249,522 to Carrier, which is hereby incorporated by reference.

Problems with these air baths result from the air distribution channels being positioned below the bottom of the vessel. These problems include an inability to completely drain water from the air channels after the air blower has stopped operating. Stagnant waste water within the air channels becomes putrid over time and creates health risks, unpleasant odors and unsightly air baths. Additionally, it is difficult to meet industry water retention standards using the plumbing of conventional air system baths. Moreover, conventional methods do not sufficiently clean these air baths and remove dirt, mildew and bacteria.

Attempts have been made to solve the problems associated with conventional air system baths. One such solution includes a drain valve assembly as described in U.S. Pat. No. 5,381,831 to Versland. The drain valve assembly includes a housing, a first valve for draining water from the bath and a second valve for draining water that has penetrated into the air distribution system. A lever positioned within the housing operates as an actuating means for lifting the first and second valve stems and opening the first and second valves. The lever is actuated by rotating a knob positioned on the side of the bath vessel. This prior art drain valve includes many intricate parts that are expensive to manufacture and assemble. Additionally, these parts provide more opportunity for the drain valve to fail. The many parts of this drain and its overall size also prohibit its use in small, compact areas. As a result, a consumer may be forced to choose between air baths based principally on the installation space required by the associated drain.

An object of the present invention is to overcome the disadvantages of the prior art.

It is also an object of the present invention to provide a drain valve that is compact and easily operated so that fluid pressure within an air distribution system is maintained when the valve is closed, and released when the valve is opened. It is further an object of the invention to provide a method of effectively cleansing the air channels of an air distribution system.

SUMMARY OF THE INVENTION

The present invention relates to a drain valve assembly for use with an air bath including a bath vessel and an air distribution system. The drain valve assembly is located within an opening in the bath vessel to control the flow of water from the bath vessel to an effluent drain. It is also securely connected to the air distribution system so that air and water within the air channels flows out through the drain valve assembly into the effluent drain. Additionally, the drain valve assembly seals an end of the air distribution system so that air pressure can be established therein and air can be introduced into the water within the vessel.

When the drain valve assembly according to the present invention is closed, water is retained within the bath vessel. Additionally, seals are formed within the closed valve for establishing and maintaining the air pressure within the air distribution channels. As a result, the drain valve seals the vessel and the air distribution system, distal the blower, so that air pressure can be repeatedly established within the air distribution channels surrounding the tub. When the drain valve assembly is open, the integrity of all of the established seals is broken and the water from the bath vessel enters the valve through an upper opening and flows into an effluent drain. Simultaneously, the established fluid pressure within the channels is released and, if the blower is not operating at a high enough speed, water remaining in the vessel enters the air channels. The water entering the channels flows, with any remaining air, into the drain assembly. The water from the air channels then flows with the water from the vessel into the effluent drain.

The drain valve assembly comprises a valve housing for extending between the bath vessel and a fluid waste pipe. The valve housing has an upper opening for positioning proximate the bath vessel and a lower opening for receiving fluid from the air bath distribution system. The lower opening extends at an angle to the upper opening and includes upper and lower surfaces. The drain valve assembly also includes a stopper having first and second vertically aligned plungers. The stopper is secured within the valve housing and is capable of moving relative thereto so that when the second plunger is positioned above the lower surface of the lower opening and the stopper is in an open position, fluid from the air distribution system flows into the fluid waste pipe. Additionally, when the second plunger is positioned below the lower surface of the lower opening and the stopper is in a closed position, fluid from the air distribution system is sealed within the valve housing.

The present invention also includes a drain valve assembly comprising a valve housing for positioning within a drain opening in a bath vessel. The valve housing includes an upper opening having a diameter, and a lower opening having a diameter that extends at an angle to the diameter of the first opening. The lower opening receives fluid from an associated air distribution system. The drain valve assembly also includes a strainer body removably secured within the valve housing, a stopper having first and second plungers, an internal channel and a longitudinal axis. A guide post including a longitudinal axis is positioned within the internal channel for supporting the stopper.

The valve assembly according to the present invention can reduce the amount of space required for drain valve assemblies used with air bath systems. Also, the present invention can be easily connected to the plumbing of an installed effluent drain. In addition, the present invention is easier to manufacture when compared to prior art drains and includes a minimum of parts. For example, the present invention uses only one stopper for sealing both the vessel and the end(s) of the air distribution system. Using fewer parts can increase the life of the drain, its ease of operation and the integrity of its seals. The fewer parts that experience wear, the tighter the seals remain over time.

The present invention further includes a method of cleansing channels of an air distribution system for a bath vessel having a drain valve for retaining fluid within the bath vessel and fluid pressure within the air distribution system. The method comprises the steps of introducing a predetermined amount of a cleansing solution into the air distribution system through a fluid inlet when the drain valve is closed, and filling the bath vessel with a fluid to a first predetermined level above air distribution holes in the bath vessel. The cleansing solution is then mixed with fluid within the bath vessel. The mixture is allowed to set within the bath vessel and the air channels for a predetermined period of time so that the cleansing solution can clean the inner wall of the bath vessel and the air channels. After the soak step, the drain valve is opened so the mixed fluid and cleansing solution flow through the air channels and into the drain valve. However, a drain cover is positioned over the open drain valve to prevent the mixed fluid and cleansing solution from flowing directly into the drain valve from the bath vessel. The drain cover is removed after the mixed fluid and cleansing solution have drained to a second predetermined fluid level that is below the first predetermined level. This method removes any bacteria and dirt that may have remained in the bath vessel or air channels after being used by a bather. Additionally, the method can be used to remove buildup from the air channels caused by stagnant water or the like.

DETAILED DESCRIPTION OF THE INVENTION

Figure 1:
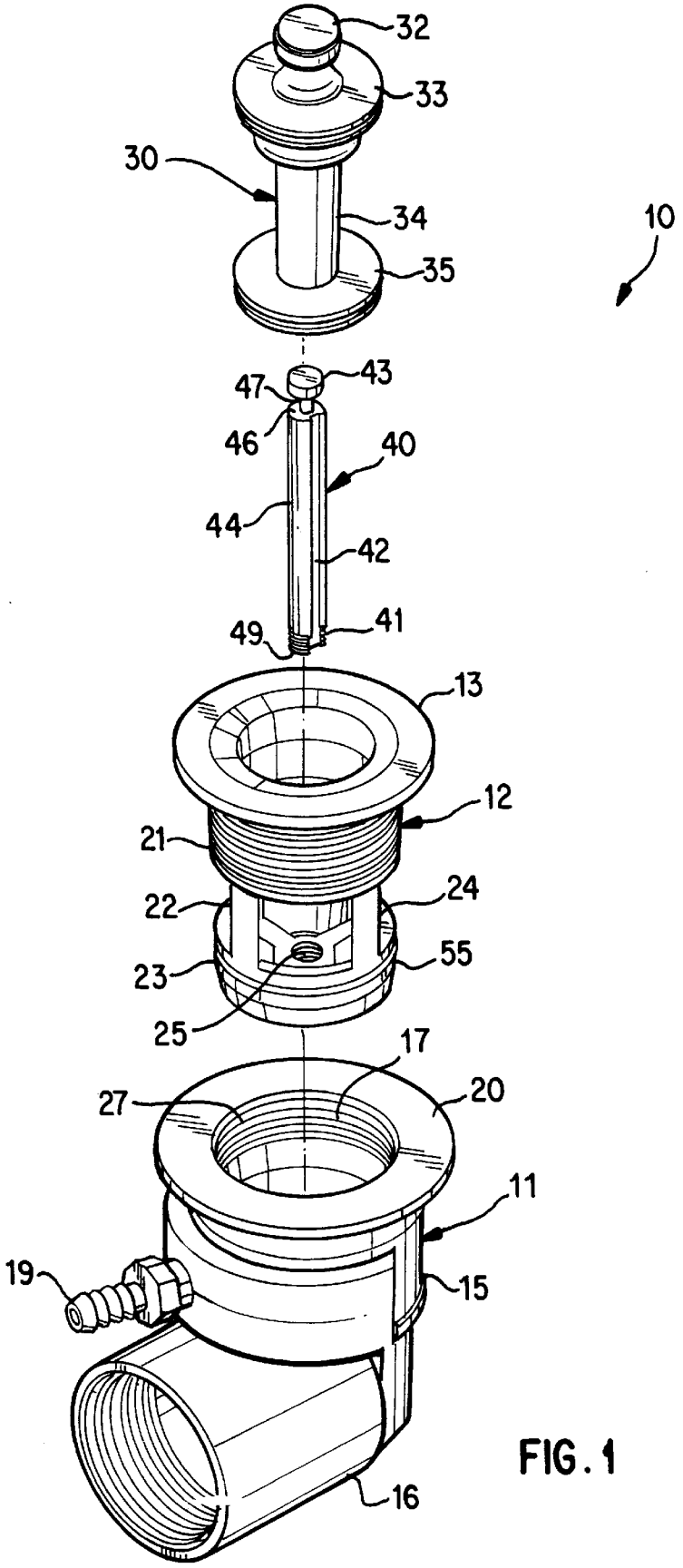
FIG. 1 is an exploded perspective view of the drain valve assembly according to the present invention.
Figure 2:
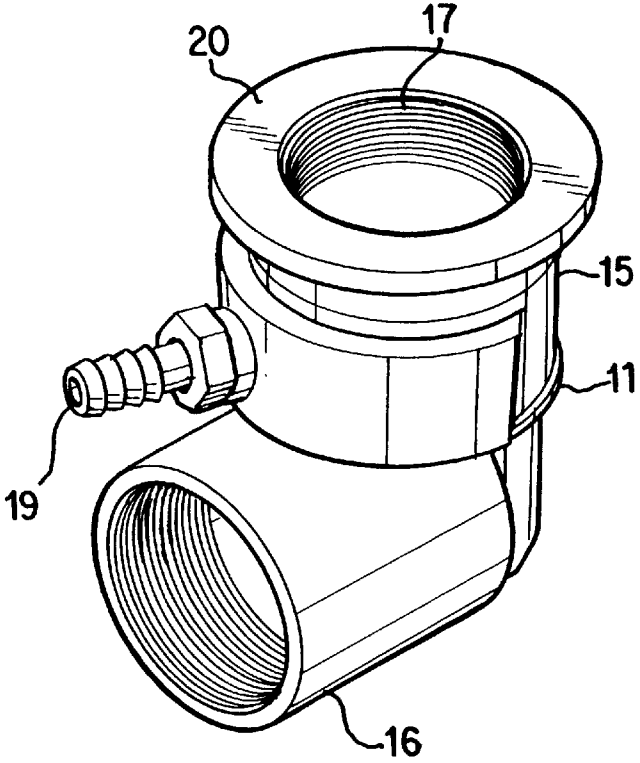
FIG. 2 is perspective view of the valve housing according to the present invention.

FIG. 1 shows a double stopper drain valve assembly 10 for maintaining and draining water in a bath shell 1 of an air bath system. Drain valve assembly 10 also maintains air within the air distribution channels 7 of an air bath system and allows air and water to drain from channels 7. Drain valve assembly 10 can be either manually or automatically operated. A manually operated embodiment is illustrated in FIGS. 1–10 and an automatically operated embodiment is illustrated in FIGS. 11–19. In both embodiments, double stopper drain valve assembly 10 is installed in a drain opening 2 in bath shell 1. Valve assembly 10 includes a valve housing 11, a double plunger stopper 30, a gasket 14, a guide post 40 and a strainer body 12 having a flange 13.

Figure 3:
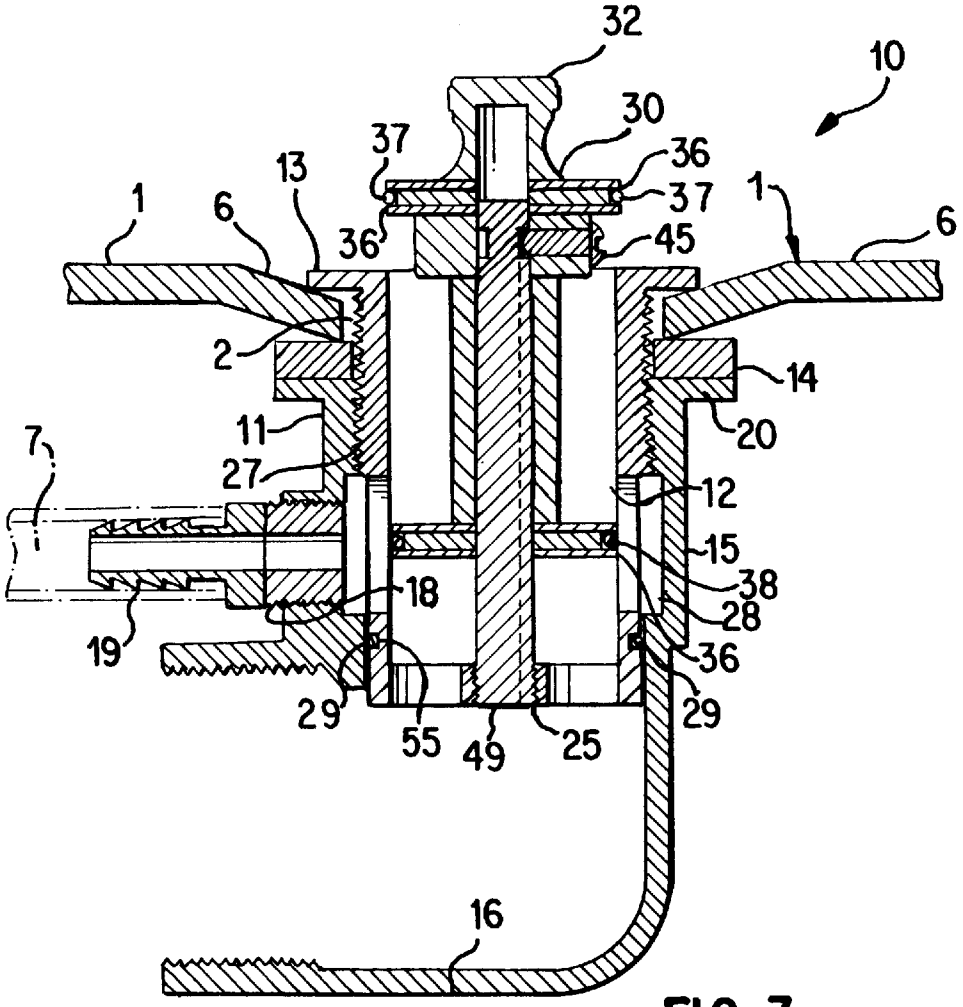
FIG. 3 is a cross-sectional view of the drain valve assembly installed in a bath vessel with the stopper in an open position.
Figure 5:
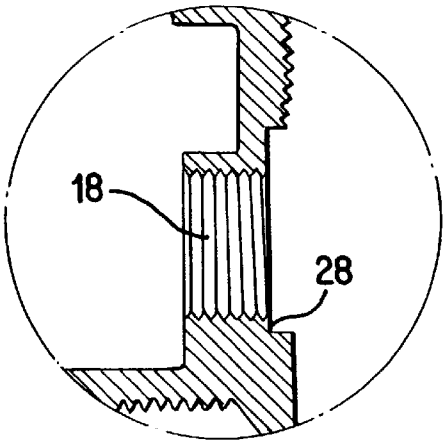
FIG. 5 is an enlarged view of the valve housing that receives the threaded fitting.
Figure 6:
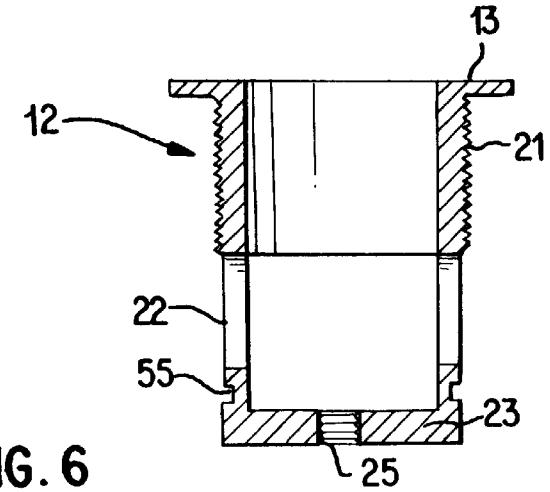
FIG. 6 is a cross section of the strainer body according to the present invention.
Figure 4:
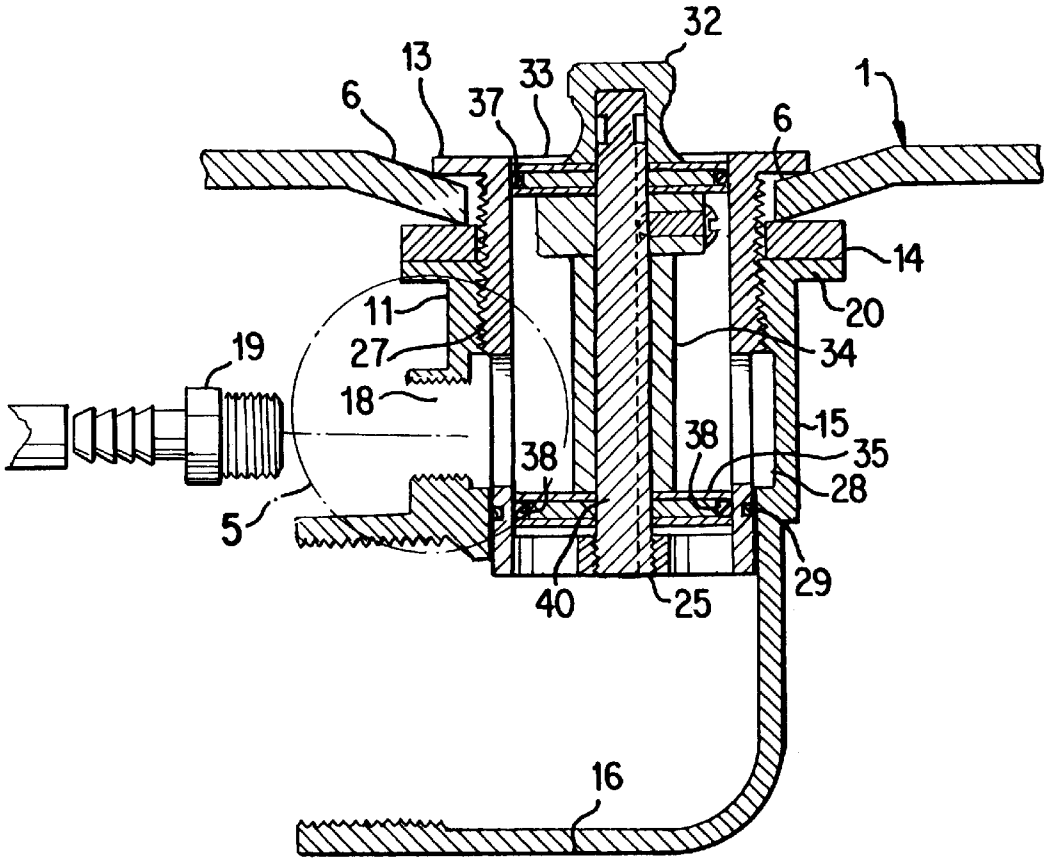
FIG. 4 is a cross-sectional view of the drain valve assembly installed in a bath vessel with the stopper in an closed position and the threaded fitting and conduit shown removed from the assembly.

As shown in FIG. 3, valve housing 11 has a first vertical section 15 including a flange 20 for contacting and supporting a sealing gasket 14 below opening 2 and between itself and bath shell 1. Vertical section 15 also includes an upper opening 17 surrounded by flange 20 and a lower opening 18 that extends through the side wall of housing 11. A barbed or other type of fitting 19 is secured within opening 18 and delivers fluids, such as air and water, from air channels 7 to the interior of valve 10, as discussed below. Fitting 19 can be secured within opening 18 using threads or any other well known securing techniques. However, in an alternative embodiment, valve housing 11 is formed as a single unit of injection molded plastic. In this alternative embodiment, fitting 19 is integrally formed with vertical section 15 as part of a single piece valve housing 11.

Vertical section 15 includes internal threads 27 for cooperating with threads on the outer surface of strainer body 12. Threads 27 allow the position of strainer body 12 to be adjusted relative to valve housing 11 so that the valve assembly 10 can be used with bath shells having different thicknesses. Threading strainer body 12 into valve housing 11 also allows for the easy separation of these parts during routine maintenance. Vertical section 15 also includes a thinner, recessed interior sidewall region 28 below threads 27. Region 28 prevents necking and allows the fluid exiting opening 18 to flow around and into the interior of strainer body 12 with minimal disturbance. Vertical section 15 connects to a horizontal section 16 to provide a continuous waste water flow path. The interior surface of horizontal section 16 includes a plurality of threads or any other well known member for securing valve housing 11 to the waste pipe of an effluent drain. While an elbow shaped valve housing 11 has been shown, a valve housing having a different shape below section 15 could also be used.

Strainer body 12 includes flange 13, an upper, threaded wall section 21, a central, open section 22 and a lower, strainer section 23. A plurality of vertically extending, spaced apart sidewalls 24 connect sections 21 and 23 to form section 22. The areas between sidewalls 24 are open to allow air to enter strainer body 12 and form a pressure in channels 7. These open areas also allow waste water from air channels 7 to flow into strainer body 12 and through strainer section 23. As shown in FIG. 3, when assembled, flange 13 is positioned on top of an inner, bottom wall surface 6 of shell 1 so that it overlaps with opening 2. Threaded section 21 extends from the underside of flange 13 through opening 2 and gasket 14. Threaded section 21 is received and secured within valve housing 11 by threads 27. As the threads of section 21 are advanced into section 15, flange 13 contacts inner wall surface 6 and brings gasket 14 into contact with shell 1 and flange 20 for sealing opening 2. As discussed above, threading section 21 into section 15 allows valve assembly 10 to achieve a custom fit each time it is installed. Gasket 14 is positioned below opening 2 and its central opening has a smaller diameter than opening 2 for forming a seal between housing 11 and shell 1.

When strainer body 12 is properly positioned and secured within housing 11, open section 22 is aligned with recessed sidewall region 28 and opening 18, as shown in FIG. 3. Strainer section 23 is positioned below recessed sidewall region 28 for stopping solid debris from entering section 16. Section 23 includes a groove 55 carrying a seal 29, such as an O-ring, for preventing waste water from flowing between housings 11 and 12.

Strainer section 23 also includes a threaded opening 25 in its center for receiving a threaded end 41 of guide post 40 so that guide post 40 cannot move relative to strainer section unless it is unscrewed. This prevents guide post 40 from prematurely and unintentionally separating from strainer section 23. Threadably securing post 40 to strainer body 12 also allows for their easy separation during servicing of valve assembly 10 or bath shell 1. As shown in FIG. 1, guide post 40 includes a head 43 for grasping during its removal. Guide post 40 also includes an elongated body 44 having a vertical guide slot 42 and threaded end 41. A pin retaining groove 47 is formed between the upper shoulder or surface 46 of body 44 and the lower surface of head 43. Guide slot 42 extends along the entire length of body 44 between upper surface 46 and lower surface 49. Guide post 40 is secured within strainer body 12 by threading end 41 into opening 25, as discussed above.

Figure 8:
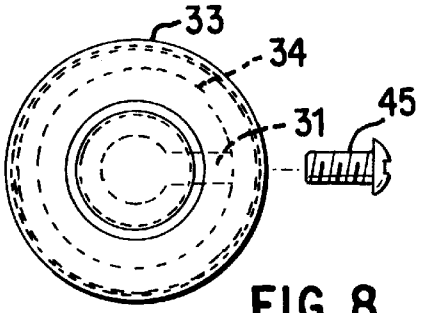
FIG. 8 is a top view of the double plunger stopper of FIG. 7.
Figure 9:
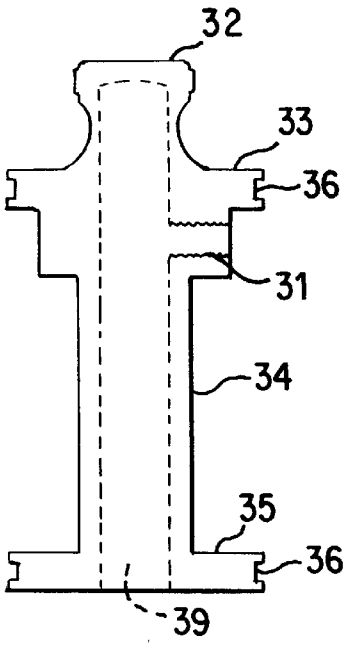
FIG. 9 is a cross section of the double plunger stopper shown in FIG. 7.
Figure 10:
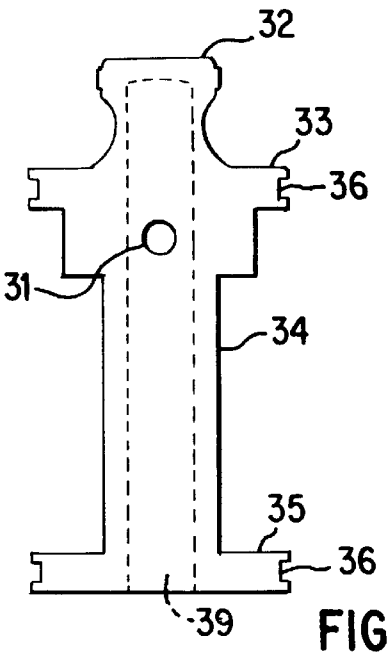
FIG. 10 is a cross section of the double plunger stopper shown in FIG. 7, rotated 90 degrees relative to FIG. 9.
Figure 7:
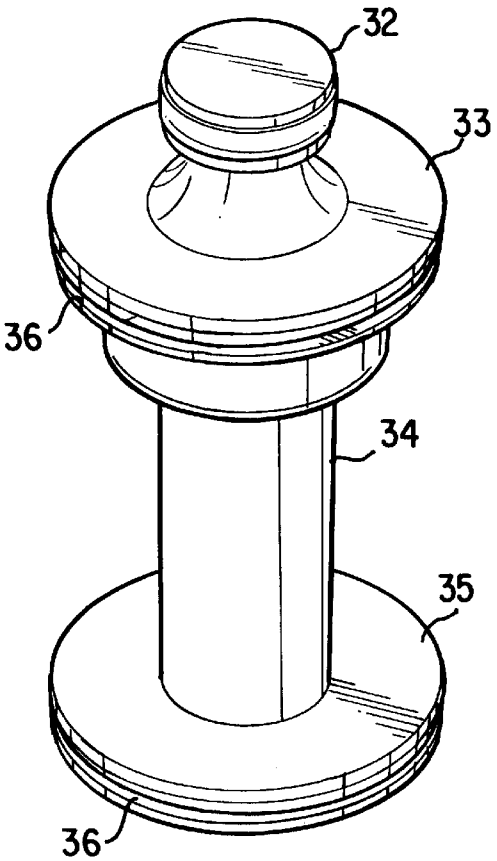
FIG. 7 is a perspective view of the double plunger stopper according to the present invention.
Figure 12:
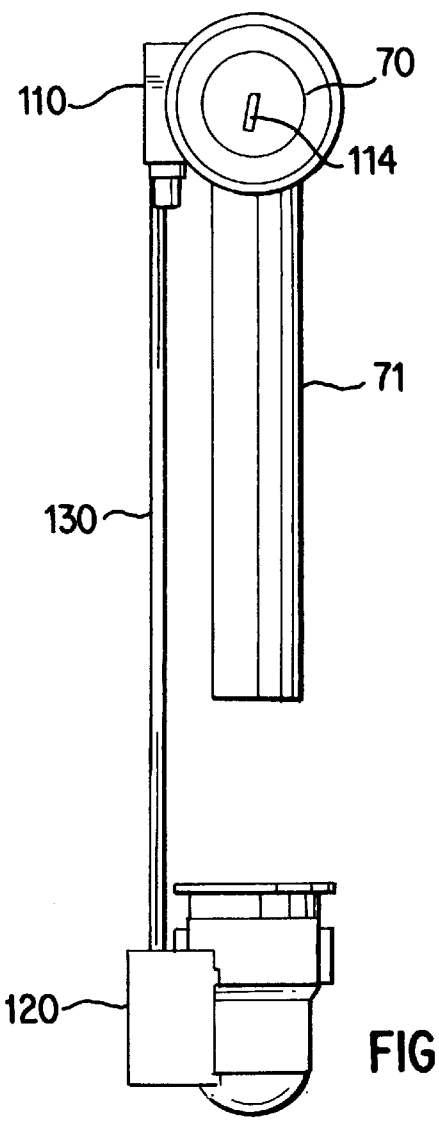
FIG. 12 is a front view of the drain valve assembly shown in FIG. 11 including the automatic opening/closing mechanism according to the present invention with the bath vessel removed and the drain pipes shown in part.
Figure 11:
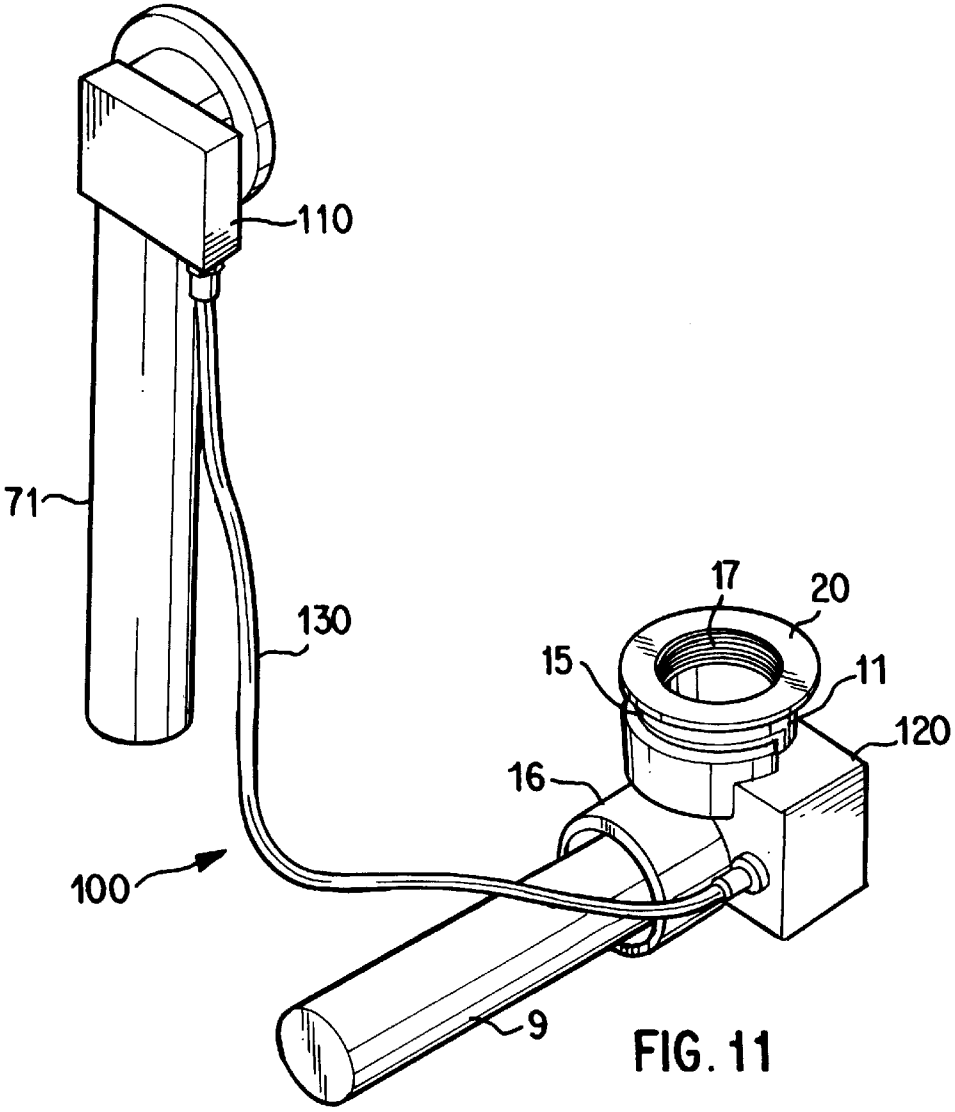
FIG. 11 is a perspective view of the drain valve assembly including the automatic opening/closing mechanism according to the present invention with the bath vessel removed and the drain pipes shown in part.

Double plunger stopper 30 includes a handle 32 that can be grasped by a user to raise and lower the stopper. Stopper 30 can be fabricated as a single unit or it can be formed of individual parts secured together. Stopper 30 also includes a vertically extending internal chamber 39 for receiving guide post 40. As discussed below, stopper 30 moves along and relative to guide post 40. Stopper 30 further includes a top plunger 33, a stem 34 and a bottom plunger 35. Stem 34 rigidly connects vertically aligned plungers 33 and 35 so there is no relative movement between them. This rigid connection ensures that both plungers 33, 35 simultaneously move an equal distance when one of the plungers is raised or lowered. Stem 34 includes a threaded channel 31 extending perpendicular to the vertical, longitudinal axis of stopper 30, and an open end providing access to slot 42, as shown in FIGS. 8 and 9. Pin 45 extends through channel 31 and into guide slot 42 for securing stopper 30 to guide post 40. Pin 45 can be any type of elongated securable member such as a screw or other well known fastener. Pin 45 extends into and travels along the length of guide slot 42 when stopper 30 is raised and lowered. Stopper 30 is kept in a raised or open position by resting pin 45 on shoulder or upper surface 46. This is accomplished by raising pin 45 above the top of slot 42 and rotating stopper 30 about its longitudinal axis so that pin 45 enters groove 47.

Plungers 33 and 35 each include a circumferential groove 36 in their vertical sidewalls. A gasket 37, 38, such as an O-ring, is positioned in a respective one of grooves 36 for creating a fluid tight seal between its respective plunger 33, 35 and the inner walls of strainer body 12 when the stopper 30 is in a closed position. Gasket 37 performs two functions when in a closed position: first, it prevents water from flowing from bath shell 1 into strainer body 12; second, gasket 37 cooperates with gasket 38 to form a fluid (air) tight region within strainer body 12 between plungers 33 and 35 for establishing fluid pressure within the air delivery system 7. By providing a fluid tight seal on both the upper and lower sides of open section 22, opening 18 can be in fluid communication with conduits 7 for maintaining fluid pressure in the air distribution system during its operation and for receiving waste water from conduits 7 when the air bath system is shut off, without destroying the integrity of air distribution system during its operation. Valve assembly 10 is closed by lowering stopper 30 so that it forms a seal with strainer body 12. From an open position, stopper 30 is lowered by rotating it about its longitudinal axis so that pin 45 aligns with slot 42. When aligned, pin 45 and stopper 30 are forced vertically downward along slot 42 until plunger 33 seats itself within the opening of strainer body 12.

Stopper 30 is secured in a open position as discussed above. When stopper 30 is in the open position, as shown in FIG. 3, the fluid tight seal within strainer body 12 is broken. Additionally, water from bath shell 1 enters strainer body 12 and flows through section 15 into section 16 and out through a pipe 9 to the effluent drain. Simultaneously, water entering air channels 7 from bath shell 1 flows through fitting 19 and opening 18 into section 28 and open section 22. After entering section 22, the water from the air channels 7 flows through strainer section 23 and into section 16.

As discussed above and as shown in FIG. 11, valve assembly 10 can be automatically and remotely operated using a cable mechanism 100 so that a user does not have to reach into the water and manually lift the stopper to open the drain valve. The embodiment shown in FIGS. 11 through 15 is similar to that shown in FIG. 1. Accordingly, common elements between these embodiments are referenced using the same numerals and their description will not be repeated. Cable mechanism 100 includes a first housing 110, a second housing 120 and a flexible cable 130. Cable 130 includes an outer covering 131 and an inner cable 132 that is longitudinally rigid for moving the stopper 30 and laterally flexible for easy installation. As shown in FIGS. 11 through 14, housing 110 forms an integral unit with overflow valve 70 and overflow waste pipe 71. Overflow valves such as valve 70 are well known in the art for maintaining the water level in a bath shell. Housing 110 can be molded with overflow valve 70 as a single unit or it can be formed separately and then secured together as an integral unit. Housing 110 covers and protects a turning mechanism 111 pivotally secured therein. Turning mechanism 111 includes a lever 112 pivotally mounted at one end on an axial pin 113. At its other end, lever 112 includes a slot 115 that receives an upper end 133 of cable 132 for transferring its motion to cable inner cable 132. Lever 112 is connected to and toggled by an actuator 114 extending into bath shell 1.

Housing 120 covers and protects a lever mechanism 121 secured therein. Lever mechanism 121 includes a long arm 122 and a short arm 123 formed of plastic or metal materials that resist oxidation. Arms 122 and 123 can be fashioned of a single member bent to form them or two separate members secured together. Arms 122 and 123 are at least partially coextensive and positioned at an acute angle $\alpha$ relative to each other. A rotating mechanism 124 for actuating lever mechanism 121 is secured to arms 122 and 123 at the vertex of angle $\alpha$. Rotating mechanism 124 includes a crank having a crank handle 126 with a first end 127 rigidly secured to an end 134 of inner cable 132 for receiving the movement of inner cable 132 caused by lever 112. Crank handle 126 also includes a second end 128 rigidly secured to a disk 129. A rotatable shaft 125 is rigidly secured to disk 129 so that it rotates when disk 129 is rotated by handle 126 and cable end 134. There is no relative movement between shaft 125 and disk 129 so that all motion is transferred between these members. As a result, shaft 125 only rotates when disk 129 rotates, such as when lever 112 is moved. Other well known mechanisms for rotating and actuating lever mechanism 121 can also be used.

Figure 15:
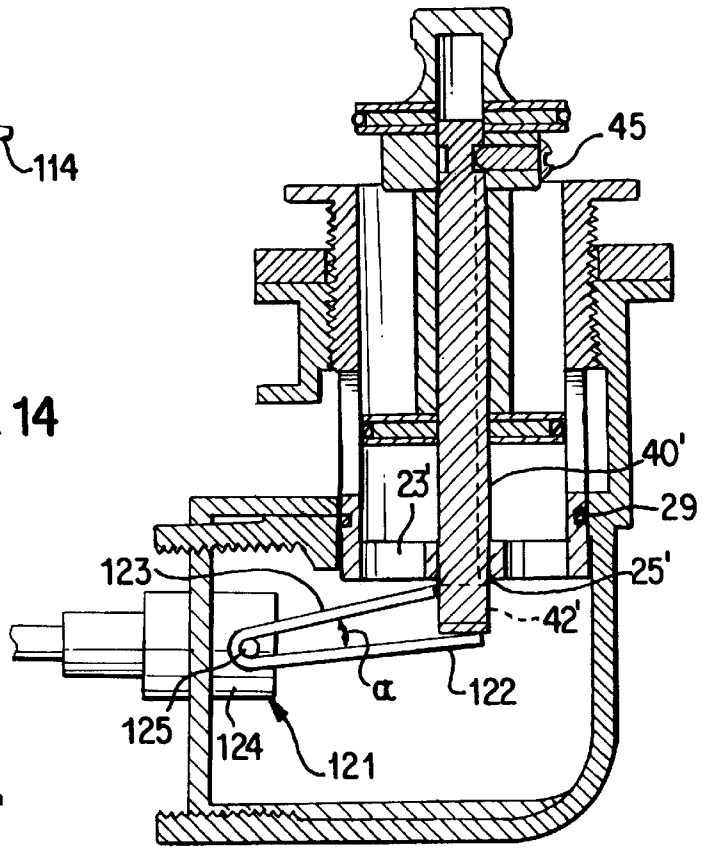
FIG. 15 is a side view of the valve assembly shown in FIG. 11 in an open position with the second, lower housing of the automatic opening/closing mechanism.
Figure 14:
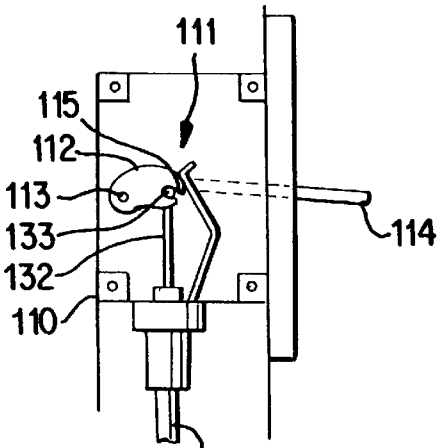
FIG. 14 is a side view of the first, upper housing of the automatic opening/closing mechanism shown in FIG. 11 with the housing and actuator partially shown in cross section.
Figure 13:
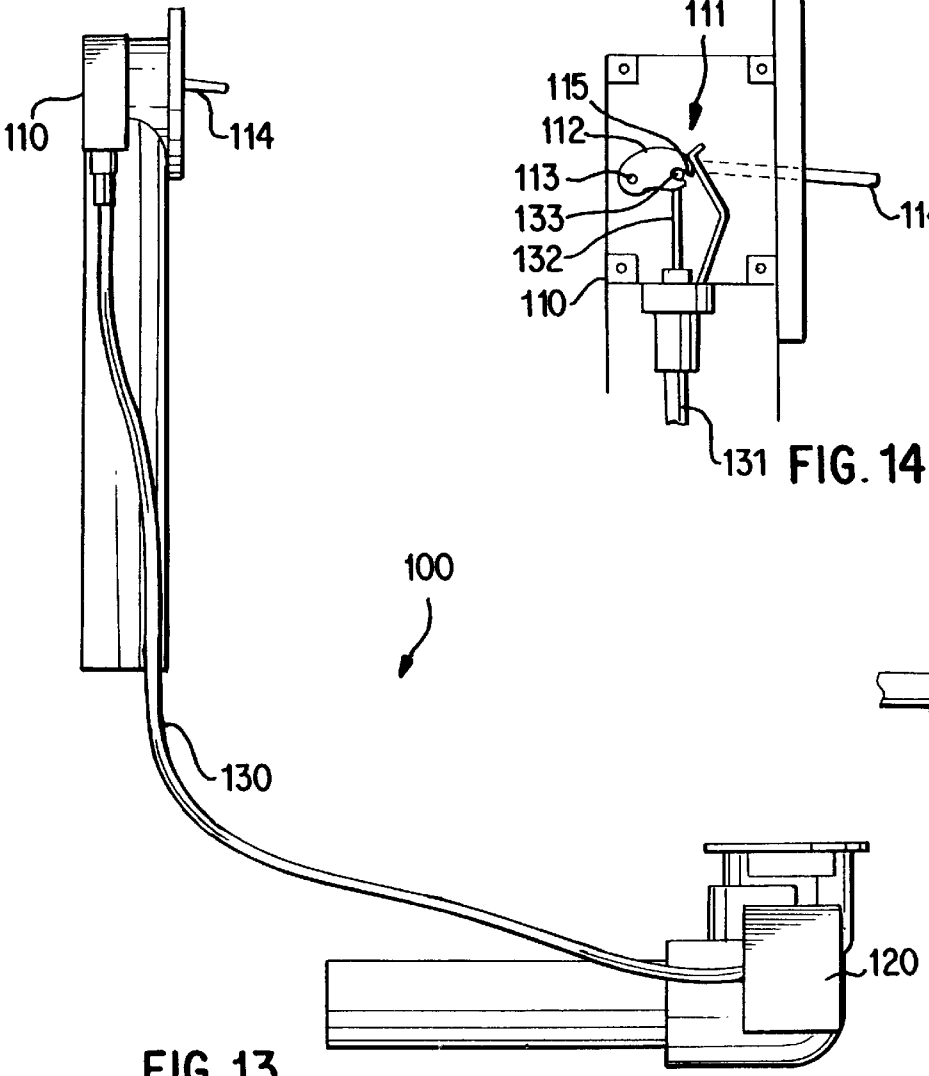
FIG. 13 is a side view of the drain valve assembly shown in FIG. 11 including the automatic opening/closing mechanism according to the present invention with the bath vessel removed and the drain pipes shown in part.
Figure 17:
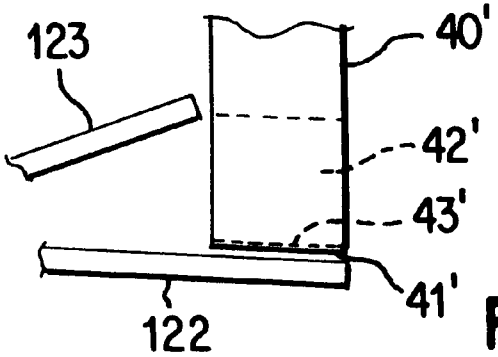
FIG. 17 is a side view of the guide post and a stopper lifting mechanism as shown in FIG. 15.
Figure 19:
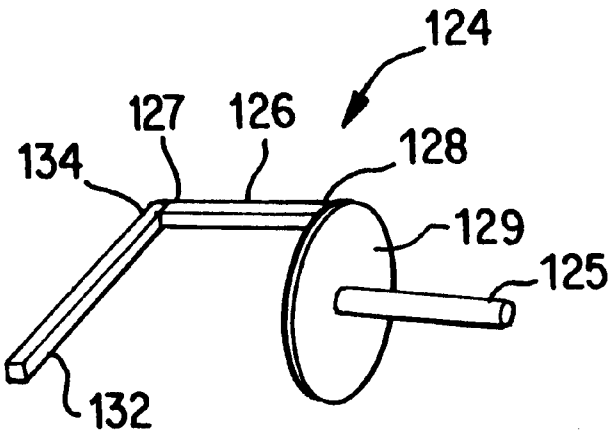
FIGS. 18 and 19 illustrate the rotating mechanism within the lower housing for moving the stopper lifting mechanism shown in FIG. 15.
Figure 16:
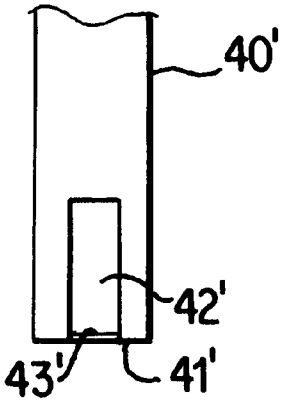
FIG. 16 is a partial view of the lower end of the guide post shown in FIG. 15 including an internal slot for receiving an arm of a lever mechanism.
Figure 18:
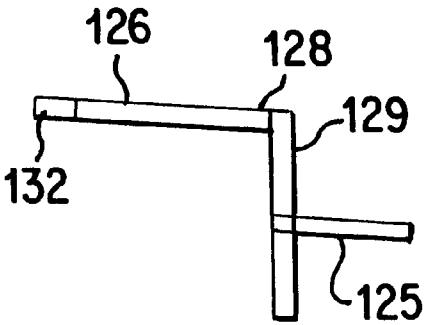

In a preferred embodiment of the drain valve assembly, a stopper lifting mechanism moves stopper 30 between open and closed positions, as shown in FIGS. 15–17. A guide post 40', which is similar to guide post 40, forms part of the lifting mechanism. Guide post 40' extends through strainer body 12 into horizontal section 16. Unlike guide post 40, guide post 40' does not include a vertical guide slot. Additionally, the lower end of guide post 40' is not secured to strainer section 23. Instead, guide post 40' is secured to stopper 30 by a well known fastener 45' so there is no relative movement therebetween. Fastener 45' includes a bolt or a pin and is positioned within stopper 30 so that it extends into and is secured within post 40'. As a result, the movement of post 40' is transferred to stopper 30. Guide post 40' includes lower end 41' having a smooth outer surface that slides within a smooth walled bearing surface formed in a central opening 25' in strainer section 23'. Lower end 41' has an internal slot 42' having an opening that faces lever mechanism 121 and cooperates therewith for raising and lowering stopper 30. As seen in FIG. 16, slot 42' does not extend through the bottom surface 43' of lower end 41'.

In operation, lever 112 is toggled by a user moving actuator 114 in a well known manner. When lever 112 is toggled into an up position, end 133 of cable 132 is raised and a length of cable 132 is drawn into housing 110, while a length of cable 132 within housing 120 retracts into covering 131. This, in turn, results in end 134 of cable 132 and crank handle 126 being moved in the direction of covering 131. Disk 129 and shaft 125 are rotated counterclockwise by the movement of end 134 and crank handle 126. Shaft 125 transfers its counterclockwise rotation to lever mechanism 121 and arms 122, 123 via their rigid connection. As arm 122 rotates counterclockwise, it contacts the bottom surface of lower end 41' and forces guide post 40' and stopper 30 upward so that plunger 33 is raised above the opening of strainer body 12.

Conversely, when lever 114 is toggled into the down position, end 133 is lowered and a length of cable 132 is forced out of housing 110. When cable 132 is forced out of housing 110 and away from covering 131 in housing 120, crank handle 126 rotates disk 129 and shaft 125 in a clockwise direction. This rotates arms 122 and 123 in a clockwise direction so that arm 123 enters slot 42' and engages with floor 43'. As arm 123 continues to rotate clockwise, it forces guide post 40' and stopper 30 downward until they close the opening to strainer body 12 and seal valve assembly 10.

Figure 21A:
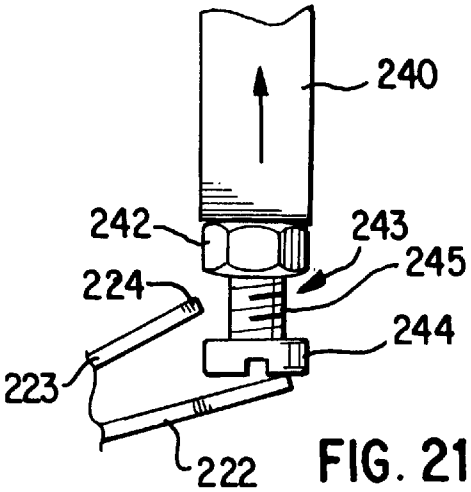
FIGS. 20–22 illustrate another embodiment of a stopper lifting mechanism according to the present invention.
Figure 22:
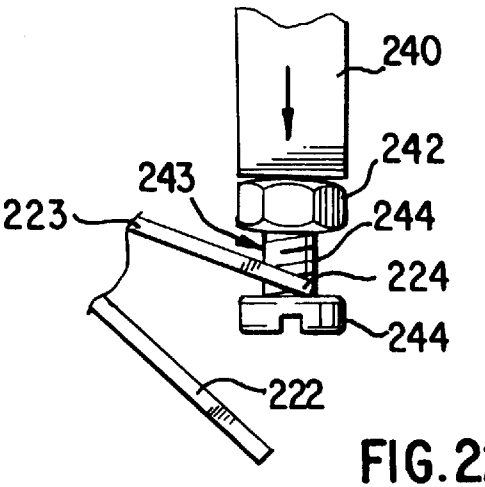
Figure 20:
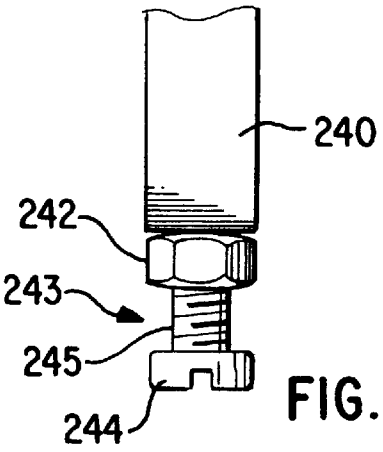
Figure 21B:
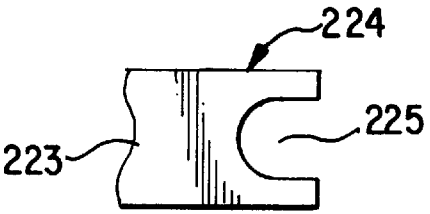
Figure 23:
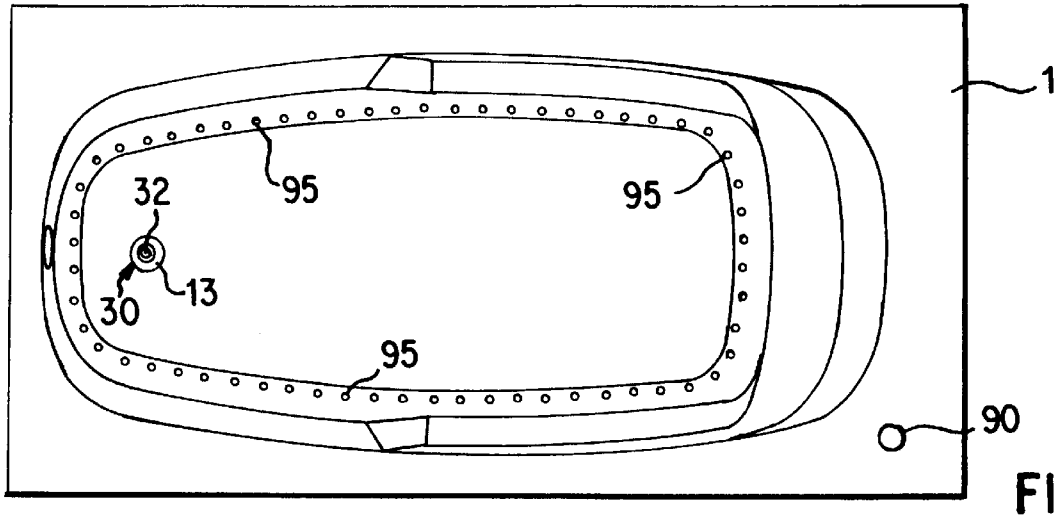
FIGS. 23–25 illustrate a bath vessel according to the present invention including an air channel cleansing system.
Figure 24:
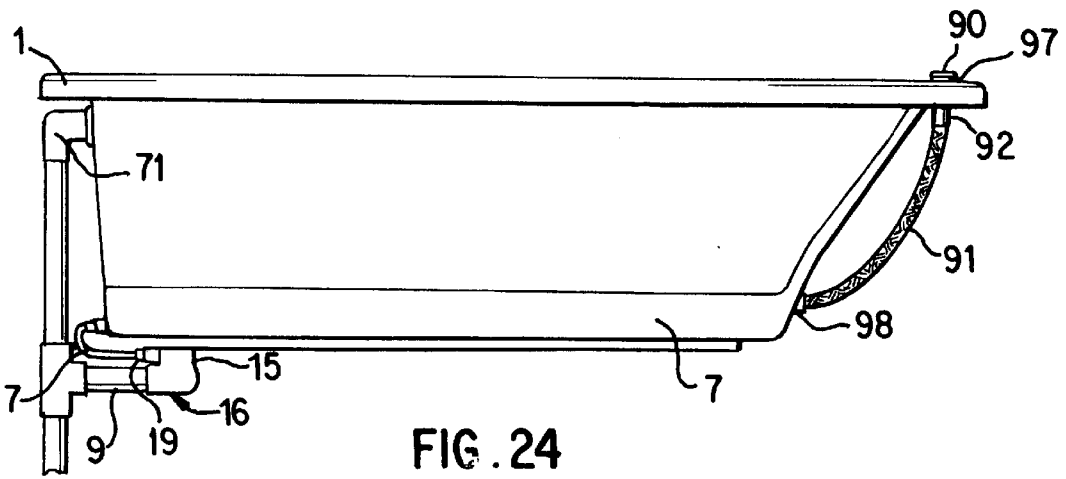
Figure 25:
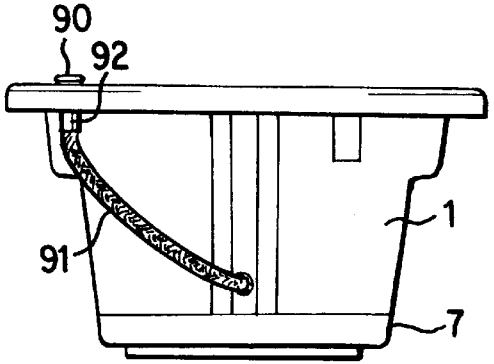
Figure 27:
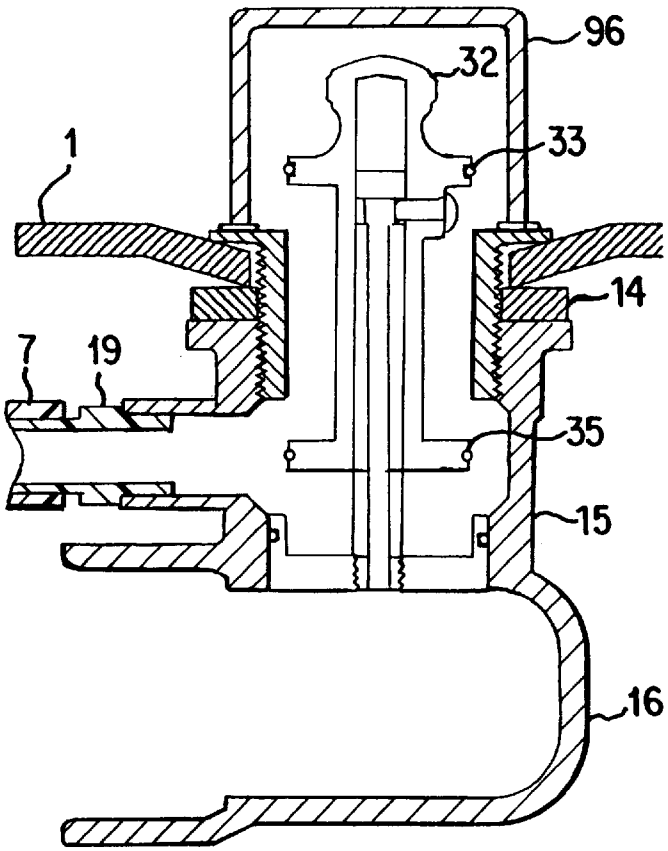
FIG. 27 is a cross section through a channel purge cap positioned over an open drain valve according to the present invention for allowing a cleansing solution within the air channels to flow out to an effluent drain.
Figure 26:
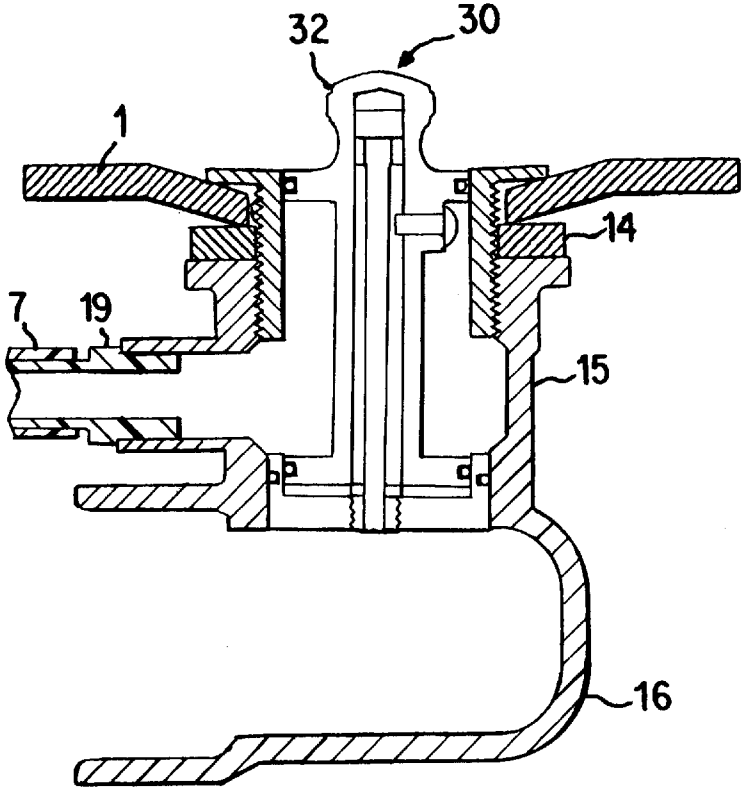
FIG. 26 is a cross section through the drain valve according to the present invention in a closed position for maintaining a cleansing solution within the air channels.

FIGS. 20–22 show another preferred embodiment of a lever mechanism 221 according to the present invention. This embodiment can be used in place of the lever mechanism 121 shown in FIGS. 16 and 17. Lever mechanism 221 includes a guide post 240 which is substantially the same as guide post 40' and extends into stopper 30 in a similar manner. However, guide post 240 does not include slot 42'. Guide post 240 includes lower end 241 having a smooth outer surface that slides within a smooth walled bearing surface formed in a central opening 25' in strainer section 23'. A locking nut 242 is rigidly secured to a bottom face of lower end 241. A bolt 243 with a contact head 244 and a threaded shaft 245 is adjustably secured to lock nut 242. The spacing between head 244 and locking nut 242 is adjusted by turning bolt 243 into, or out of, locking nut 242.

In this embodiment, lever mechanism 221 includes arms 222 and 223 which are similar to arms 122 and 123, respectively. As a result, the discussion of arms 222 and 223 will be limited to how they differ from arms 122 and 123. Arm 222 has an elongated shape that allows it to contact and transfer force to head 244. As shown in FIG. 21 (B), arm 223 includes a forked end 224 having a U-shaped cutout 225. Arm 223 receives a portion of threaded shaft 245 within U-shaped cutout 225.

During the operation of lever mechanism 221, arms 222 and 223 are pivoted in the same manner as described above with respect to lever mechanism 121. When arms 222 and 223 rotate counterclockwise (opening stroke), arm 223 rotates away from bolt 243 and arm 222 contacts the outer, lower surface of head 244. As shown in FIG. 21 (A), arm 222 applies a force to bolt 243 and guide post 240 which moves stopper 30 into an open position. As shown in FIG. 22, when arms 222 and 223 are rotated in a clockwise direction (closing stroke), arm 222 moves away from bolt 243 and forked end 224 receives threaded shaft 245. As arm 223 continues to rotate, it moves down the length of threaded shaft 245 and contacts an inner surface of head 244. Arm 222 applies a force to bolt 243 and guide post 240 that moves stopper 30 to a closed position, as shown in FIG. 22.

Lever mechanism 221 can be used with different drain assemblies and adjusted to the particular needs of each assembly. For each drain valve assembly, the distance between locking nut 242 and the head 244 of bolt 243 can be adjusted so that the closing stroke of arm 223 is long enough to seat stopper 30 in a closed position. Additionally, if the space between open stopper 30 and the surface of the bath shell needs to be increased, the distance between locking nut 242 and head 244 can be increased.

The present invention also includes a method for cleansing the air distribution system to prevent and remove built-up dirt, bacteria, mildew, etc. from air channels 7 and air distribution holes 95. The method includes introducing a predetermined amount of a well known cleansing solution into air channels 7. The solution is introduced through an opening 97 on bath shell 1. A filler cap 90 covers opening 97. A conduit 91 extends between filler cap 90 and air channels 7 for delivering the cleansing solution poured into opening 97. Filler cap 90 and opening 97 can be located at any point along the length of the bath shell that allows the introduced solution to enter the air distribution system. A one-way check valve 92 in conduit 91 opens to allow the cleansing solution introduced into opening 97 to flow into conduit 91 and prevents the established pressure within the air distribution system from escaping, regardless of whether or not filler cap 90 is securely positioned over opening 97.

As previously discussed, the air distribution system is sloped along the length of bath shell 1 toward the end including the drain assembly. As a result, conduit 91 introduces the cleansing solution into the air distribution system at its highest point 98 so that the solution will enter all of the air channels.

The cleansing method also includes completely draining the bath shell of any water or fluid and closing the drain assembly. Next, filler cap 90 is removed and a predetermined amount of the cleansing solution is poured into conduit 91. The amount of cleansing solution can vary depending on the size of the bath shell and the air channels, and the concentration of the solution. For a standard size bath shell, approximately eight ounces of cleansing solution would be introduced. Additional cleansing solution may be required if air channels 7 and/or air distribution holes 95 require extra cleansing. After the solution has entered air channels 7, the bath is filled with hot water to a predetermined level that is between 4 and 8 inches above the air inlet holes 95 extending around the inner surface of bath shell 1. In a preferred embodiment, the water is filled to a level that is substantially 6 inches above holes 95. The blower of the air distribution system is then turned on, and the cleansing solution and hot water are mixed. The blower is operated for approximately two minutes and then shut off. However, the time will vary depending on the amount of water in the bath shell, the amount of cleansing solution and the condition of the air distribution channels. The mixed water and cleansing solution are allowed to remain in bath shell 1 and air channels 7 for a predetermined amount of time, such as thirty to forty-five minutes. Then, stopper 30 is lifted and locked in an open position so the seals between plungers 33, 35 and the inner walls of strainer body 12 are broken. Immediately after stopper 30 is locked open, a channel purge cap 96 is positioned over stopper 30. As a result, the mixture of water and cleansing solution only exits bath shell 1 through holes 95 and flows to the effluent drain through air conduits 7. Channel purge cap 96 is removed when the water within the bath shell goes below air distribution holes 95 so that the entire bath shell can drain. Stopper 30 is then lowered and the drain valve is closed. Bath shell 1 and air channels 7 are then rinsed by closing the drain valve and introducing clean, cold water into bath shell 1. The bath shell is filled to a predetermined level above the air inlet holes, preferably at or above the predetermined level of the water and cleansing solution mixture. After the rinsing water has been allowed to set for a short period of time, stopper 30 is raised and the water flows out of bath shell 1 through air channels 7 and the upper drain opening.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention. For instance, the drain valve assembly could be used with a system that distributes other types of fluids into the tub, such as water. Also, the drain valve assembly could be secured to the ends of more than one channel of the same or multiple fluid distribution systems.

We claim:

1. A drain valve for use with an air bath having a bath vessel and an air distribution system, said drain valve comprising:

a valve housing for extending between the bath vessel and a fluid waste pipe, said valve housing including an upper opening for positioning proximate the bath vessel and a lower opening for receiving fluid from said air bath distribution system, said lower opening extending at an angle to said upper opening and including upper and lower surfaces;

a stopper including first and second vertically aligned plungers, said stopper being secured within said valve housing and being capable of moving relative thereto such that said second plunger is positioned above said lower surface of said lower opening when said stopper is in an open position for allowing fluid from the air distribution system to flow into the fluid waste pipe, and said second plunger is positioned below said lower surface of said lower opening when said stopper is in a closed position for sealing fluid from the air distribution system within said valve housing.

2. The drain valve according to claim 1 further including an elongated housing removably secured within said valve housing, said elongated housing including at least one opening for allowing fluid exiting said lower opening to flow into said elongated housing and out to the waste pipe.

3. The drain valve according to claim 2 wherein said elongated housing includes a strainer for preventing solid debris from entering the fluid waste pipe.

4. The drain valve according to claim 2 wherein said elongated housing includes an upper flange for positioning within said bath vessel and an upper section for engaging with said valve housing.

5. The drain valve according to claim 4 wherein said elongated housing further includes a central section including a plurality of sidewalls and an opening between each sidewall, each said opening being aligned with said lower opening in said valve housing when installed therein for allowing fluid to flow from the air distribution system into said elongated housing.

6. The drain valve according to claim 5 wherein said elongated housing is a strainer housing further including a lower section having a strainer and an aperture; and said lower end of said guide post is removably secured within said aperture when said drain valve is assembled.

7. The drain valve according to claim 6 wherein said valve housing further includes a member being secured within said second opening and extending from said valve housing for receiving fluid from the air distribution system.

8. The drain valve according to claim 2 wherein said valve housing further includes a recessed interior region proximate said second opening for receiving fluid from said air distribution system.

9. The drain valve according to claim 2 further including a guide post positioned within said stopper, said guide post having a portion for extending through said elongated housing; and said drain valve further including a raising and lowering mechanism operatively connected to said guide post for moving said stopper between said open and closed positions.

10. The drain valve according to claim 9 wherein said guide post includes a lower end having an elongated opening extending parallel to a longitudinal axis of said plunger; and said raising and lowering mechanism includes a lever mechanism having a pair of arms, whereby a first one of said arms cooperates with a lower surface of said guide post for raising said stopper when said raising and lowering mechanism is moved to an open position and the other one of said arms cooperates with said elongated opening for lowering said stopper when said raising and lowering mechanism is moved to a closed position.

11. The drain valve according to claim 9 wherein an elongated member having a contact element extends from a lower end of the guide post, said elongated member having a reduced cross section compared to said guide post; and said raising and lowering mechanism includes a lever mechanism having a pair of arms, whereby a first one of said arms cooperates with a lower surface of said contact element for raising said stopper when said raising and lowering mechanism is moved to an open position, and the other one of said arms partially surrounds a portion of said elongated member and contacts an upper surface of the contact element for lowering said stopper when said raising and lowering mechanism is moved to a closed position.

12. The drain valve according to claim 11 wherein said contact element is adjustably spaced from the lower end of said guide post.

13. The drain valve according to claim 1 wherein said first and second plungers each include a sealing member for cooperating with said valve housing when said stopper is in said closed position to prevent fluid from flowing between each of said plungers and said valve housing.

14. The drain valve according to claim 1 wherein said stopper includes an internal channel having a longitudinal axis; and said fluid drain valve further includes a guide post positioned within said internal channel for supporting said stopper.

15. The drain valve according to claim 14 wherein said guidepost includes a longitudinal axis, an upper end, a lower end and an elongated groove extending between said upper and lower ends; and said stopper includes a slot extending within said stopper at an angle to said longitudinal axis of said internal chamber.

16. The drain valve according to claim further including a pin positioned within said slot in said stopper for extending into said groove when said guide post is positioned within said stopper, wherein said pin slides within said groove when said stopper is moved between said first and second positions.

17. A drain valve for use with an air bath having an air distribution system, said drain valve comprising:

a valve housing for positioning within a drain opening in a bath vessel, said valve housing including an upper opening having a diameter, and a lower opening having a diameter that extends at an angle to said diameter of said first opening, said lower opening for receiving fluid from said air distribution system;

a strainer body removably secured within said valve housing;

a stopper having first and second plungers, an internal channel and a longitudinal axis; and a guide post including a longitudinal axis positioned within said internal channel for supporting said stopper.

18. The drain valve according to claim 17 wherein said guidepost includes a groove extending parallel to said longitudinal axis of said guide post, an upper end and a lower end; and said stopper includes a slot extending within said stopper at an angle to said longitudinal axis.

19. The drain valve according to claim 18 further including a pin positioned within said slot in said stopper for extending into said groove when said guide post is positioned within said stopper, such that said pin slides within said groove when said stopper is moved between an open position and a closed position.

20. The drain valve according to claim 17 wherein said strainer body includes an upper flange for positioning against a surface of the bath vessel and an upper section for engaging with said valve housing.

21. The drain valve according to claim 20 wherein said strainer body further includes a central section having a plurality of vertically extending openings aligned with said lower opening in said valve housing when installed therein for allowing fluid to flow from the air distribution system into said strainer body.

22. The drain valve according to claim 21 wherein said strainer body further includes a lower section having a strainer with a plurality of horizontally extending openings and a threaded aperture; and said lower end of said guide post being removably secured within said aperture of said lower section when said drain valve is assembled.

23. The drain valve according to claim 22 wherein said valve housing further includes a coupling member extending therefrom and being secured relative to said lower opening for receiving fluid from the air distribution system.

24. The drain valve according to claim 17 wherein said valve housing further includes a recessed interior region proximate said lower opening for receiving fluid from said air distribution system and delivering it to an interior of said strainer housing.

25. The drain valve according to claim 17 wherein said first and second plungers each include a sealing member for cooperating with said valve housing when said stopper is in a closed position to prevent fluid from flowing between each of said plungers and said valve housing.

26. The drain valve according to claim 17 further including a raising and lowering mechanism operatively connected to said guide post for moving said stopper.

27. The fluid drain valve according to claim 26 wherein said guide post includes a lower end having an elongated opening extending parallel to the longitudinal axis of said stopper when assembled; and said raising and lowering mechanism includes a lever mechanism having a pair of arms, whereby a first one of said arms cooperates with a lower surface of said guide post for raising said stopper when said raising and lowering mechanism is moved to a first position and the other one of said arms cooperates with said elongated opening for lowering said stopper when said raising and lowering mechanism is moved to a second position.

28. The drain valve according to claim 26 wherein an elongated member having a contact element extends from a lower end of the guide post, said elongated member having a reduced cross section compared to said guide post; and said raising and lowering mechanism includes a lever mechanism having a pair of arms, whereby a first one of said arms cooperates with a lower surface of said contact element for raising said stopper when said raising and lowering mechanism is moved to an open position, and the other one of said arms partially surrounds a portion of said elongated member and contacts an upper surface of the contact element for lowering said stopper when said raising and lowering mechanism is moved to a closed position.

29. The drain valve according to claim 28 wherein said contact element is adjustably spaced from the lower end of said guide post.

30. The drain valve according to claim 17 wherein said internal chamber extends between said first and second plungers.

31. A method of cleansing channels of an air distribution system for a bath vessel having a drain valve for retaining fluid within the bath vessel and fluid pressure within the air distribution system, said method comprising the steps of:

a) introducing a predetermined amount of a cleansing solution into the air distribution system through a fluid inlet when the drain valve is closed;

b) filling the bath vessel with a fluid to a first predetermined level above air distribution holes in the bath vessel;

c) mixing said cleansing solution with said fluid and allowing the mixture to set within the air distribution system and the bath vessel;

d) opening the drain valve so the mixed fluid and cleansing solution flow through the air channels and into the drain valve;

e) positioning a drain cover over the open drain valve to prevent the mixed fluid and cleansing solution from flowing directly into the drain valve from the bath vessel; and f) removing said drain cover after the fluid and cleansing solution has reached a second predetermined level below said first predetermined level.

32. The method according to claim 31 further including the step of rinsing the bath vessel and the air distribution system, said rinsing step including:

a) closing the drain valve after said drain cover has been removed;

b) refilling said bath vessel with water to substantially said first predetermined level; and c) reopening said drain valve so that said water flows into said drain valve from the bath vessel and the air distribution channels.

33. The method according to claim 31 wherein a conduit having a one-way valve extends between said fluid inlet and said air channels.

34. The method according to claim 31 wherein said mixing step includes operating a blower of said air distribution system.

35. The method according to claim 31 wherein said first predetermined level is approximately six inches above said air distribution holes.

* * * * *